United States Patent [19]

Obayashi et al.

[11] 4,059,040

[45] Nov. 22, 1977

[54] TONE-SOURCE APPARATUS FOR ELECTRONIC MUSICAL INSTRUMENT

[75] Inventors: Nobuharu Obayashi; Hikaru Hashizume; Noriji Sakashita; Seiji Kameyama; Sadaaki Ezawa; Toshio Kugisawa; Yutaka Washiyama; Tatsunori Kondo; Hironori Watanabe, all of Hamamatsu, Japan

[73] Assignee: Kabushiki Kaisha Kawai Gakki Seisakusho, Hamamatsu, Japan

[21] Appl. No.: 612,174

[22] Filed: Sept. 10, 1975

[30] Foreign Application Priority Data

Sept. 11, 1974 Japan ..... 49-104729
Sept. 12, 1974 Japan ..... 49-105861

[51] Int. Cl.[2] ..... G10H 1/06; G10F 1/00

[52] U.S. Cl. ..... 84/1.03; 84/1.01; 84/1.22

[58] Field of Search ..... 84/1.01, 1.03, 1.11, 84/1.19, 1.22

[56] References Cited

U.S. PATENT DOCUMENTS 3,515,792 6/1970 Deutsch ..... 84/1.03
3,823,390 7/1974 Tomisawa ..... 84/1.01

*Primary Examiner*—E. S. Jackmon

*Attorney, Agent, or Firm*—Haseltine, Lake & Waters

[57] ABSTRACT

A tone source apparatus for an electronic musical instrument is characterized in that at least one cycle of a musical-tone waveform, which it is desired be produced, is depicted as a sequence of section lines and a series of pulses having regular intervals is varied, by a pulse-density varying circuit, in pulse density in accordance with the degrees of inclination of the respective section lines. The resultant series of pulses having varied pulse density is formed, by a waveform forming circuit, into the desired musical tone waveform. The pulse-density varying circuit comprises a first counter to which is applied as an input, the aforementioned series of pulses having regular intervals. A second counter is connected, in series or in parallel, to the first counter and a decoder is connected to an output terminal of the second counter. A memory circuit is connected to the output terminals of the decoder. The memory circuit comprises a plurality of pulse-density setting portions which set frequency-dividing ratios for the first counter for selecting output pulse-densities. The memory circuit also comprises a plurality of section range setting portions which set frequency-dividing ratios for the second counter for selecting output time intervals of signals obtained at respective output terminals of the decoder.

7 Claims, 19 Drawing Figures

TONE-SOURCE APPARATUS FOR ELECTRONIC MUSICAL INSTRUMENT

FIELD OF THE INVENTION

This invention relates to a tone source apparatus for electronic musical instruments.

BACKGROUND

With respect to means for forming a musical-tone waveform in an electronic musical instrument, it has been hitherto conventional for a saw-tooth wave, a stepped form wave or the like to be passed through a filter. However, not all desired musical-tone waveforms can be obtained by such means.

SUMMARY OF THE INVENTION

This invention has as an object the provision of a simple apparatus whereby any desired musical-tone waveform can be obtained.

According to the present invention, at least one cycle of a predetermined musical-tone waveform, which it is desired be produced, is drawn as a plurality of section lines. A series of pulses having regular intervals is varied, through a pulse-density varying means, into such a pulse density that that pulse density is varied in accordance with the degrees of inclination of the respective section lines. The resultant series of pulses, having such varied pulse density, is formed by a waveform forming means into the desired musical-tone waveform.

BRIEF DESCRIPTION OF THE DRAWING

FIGS. 3 (*b*-1) – (*b*-4) are diagrams showing output waveforms of said counter;

FIG. 3(*c*) is a diagram showing digital signs indicating signals obtained at output terminals of exclusive OR circuits in the circuit of FIG. 2, and decimal signs thereof;

FIG. 3(*d*) is a diagram showing an output waveform of a D-A convertor in the circuit of FIG. 2;

DETAILED DESCRIPTION

Figure 1:
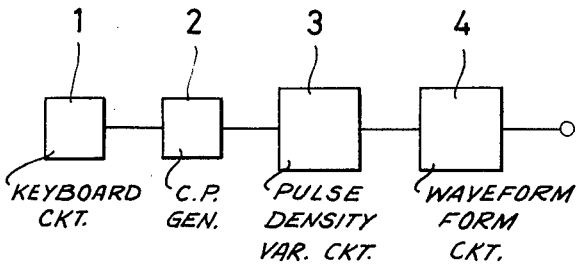
FIG. 1 is a block diagram of circuit according to the invention.

In FIG. 1, circuit 1 is a keyboard circuit which serves to generate a driving signal when a key is depressed. Circuit 2 is a clock-pulse oscillator or generator adapted for being driven by the aforementioned driving signal. Circuit 3 is a pulse-density varying circuit for varying the pulse density of output pulses received from the clock-pulse oscillator or generator 2. Circuit 4 is a waveform forming means for forming a stepped form of wave according to output pulses of the pulse-density varying circuit 3.

Figure 2:
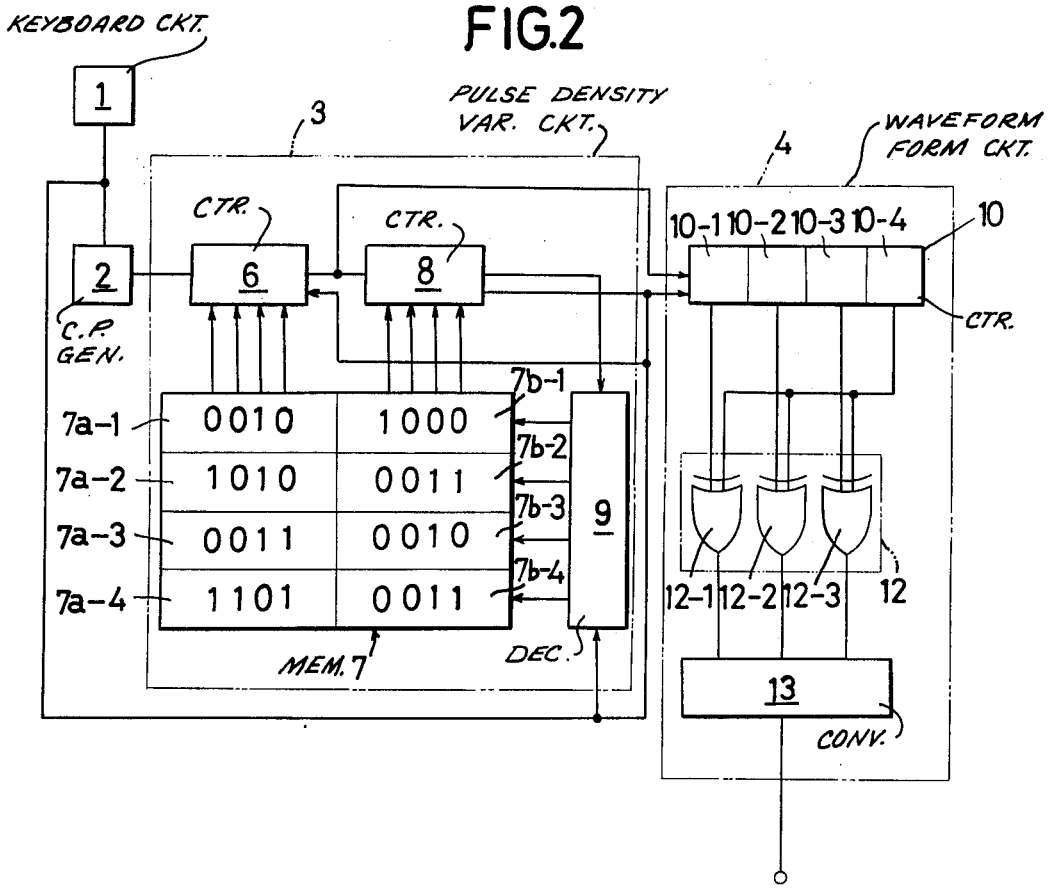
FIG. 2 is a block diagram showing a specific embodiment of this invention.

The pulse-density varying circuit 3 comprises, as shown in FIG. 2, a first counter 6 connected to an output terminal of the clock-pulse oscillator 2, a second counter 8 connected to an output terminal of counter 6, a decoder 9 connected to an output terminal of counter 8 and a memory circuit 7 connected to a plurality of output terminals of decoder 9. The memory circuit 7 comprises first to fourth pulse-density setting portions *7a*-1 . . . *7a*-4, for setting frequency-dividing ratios for the first counter 6 for establishing the output pulse densities thereof and first to fourth section range setting portions *7b*-1 . . . *7b*-4 for setting frequency-dividing ratios of the second counter 8 for establishing section ranges, that is, the output time intervals of the respective output terminals of the decoder 9 and, accordingly, time lengths for outputs of set-interval pulses transmitted from the first counter 6. Respective corresponding stage setting portions on the right and left (that is, stages *7a*-1, *7b*-1 . . . *7a*-4, *7b*-4) are respectively connected, in common, to respective corresponding stage output terminals of the decoder 9. Each of the setting portions comprises a setting portion of four bits of the binary scale and has four output leads exiting therefrom. Four output leads exit in common from the first to fourth pulse-density portions *7a*-1 . . . *7a*-4 and four exit in common from the first to fourth section range setting portions *7b*-1 . . . *7b*-4 and are connected to the first counter 6 and the second counter 8, respectively. Memory circuit 7 can be simply constructed as a read only memory or a diode-matrix memory.

The decoder 9 comprises, for instance, a ring counter, and is driven by output pulses of the second counter 8 such that output pulses can be obtained, in order, from the first to fourth output terminals thereof and thereby the first to fourth pulse-density setting portions *7a*-1 . . . *7a*-4 and the first to fourth section range setting portions *7b*-1 . . . *7b*-4 can be, in order, selected.

The first and the second counters 6 and 8 are each composed of a programmable counter. These are so arranged so that automatically, when output digital signals of the setting portions *7a*-1 . . . *7a*-4 and the setting portions *7b*-1 . . . *7b*-4 coincide with respective values counter by the first and second counters 6 and 8, the counters generate reset signals for being reset.

Figure 3:
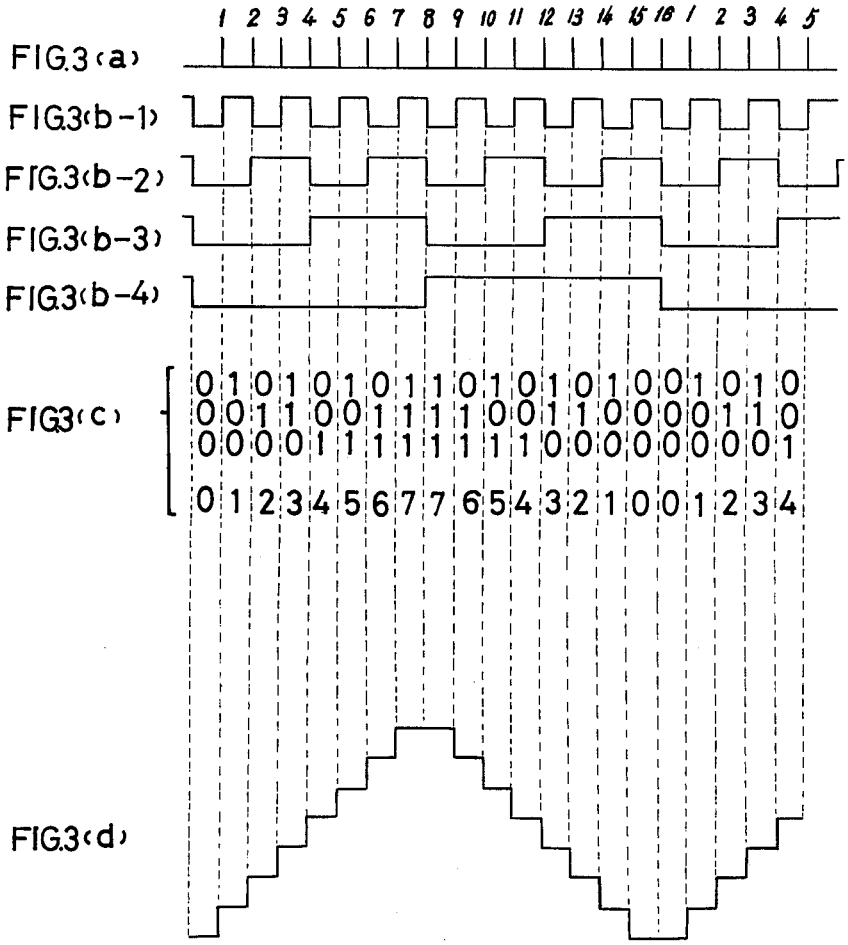
FIG. 3(*a*) is a diagram showing a series of clock pulses directly applied to a counter in the circuit of FIG. 2.

The waveform forming circuit 4 comprises a third counter 10, an exclusive OR-gate circuit group 12 connected to a plurality of output terminals of a plurality of flip-flop circuits 10-1 . . . 10-4 constituting the third counter 10, and a D-A converter 13 connected to output terminals of the exclusive OR-gate circuit group 12. Three exclusive-OR-gate circuits 12-1, 12-2 and 12-3 constituting the exclusive-OR-gate circuit group 12 respectively have two input terminals, and one of the input terminals thereof are connected to output terminals of the first to third flip-flop circuits 10-1, 10-2 and 10-3. The other input terminals thereof are connected in common and are, through a common line, connected with an output terminal of the fourth flip-flop circuit 10-4. Thus, if clock pulses uniform in pulse density, as shown in FIG. 3(*a*), are applied to the third counter 10, output signals of the flip-flop circuits 10-1 . . . 10-4 are such as shown in FIG. 3(*b*-1) . . . FIG. 3(*b*-4). Thereby, the exclusive OR gate circuits 12-1, 12-2 and 12-3 generate output signals 0,1 . . . 7,7 . . . 1,0, in digital form, as shown in FIG. 3(*c*). Then, these digital signals are converted, by the D-A converter 13, into analog signals to form a stepped form of generally sine shape as shown in FIG. 3(*d*).

Figure 4:
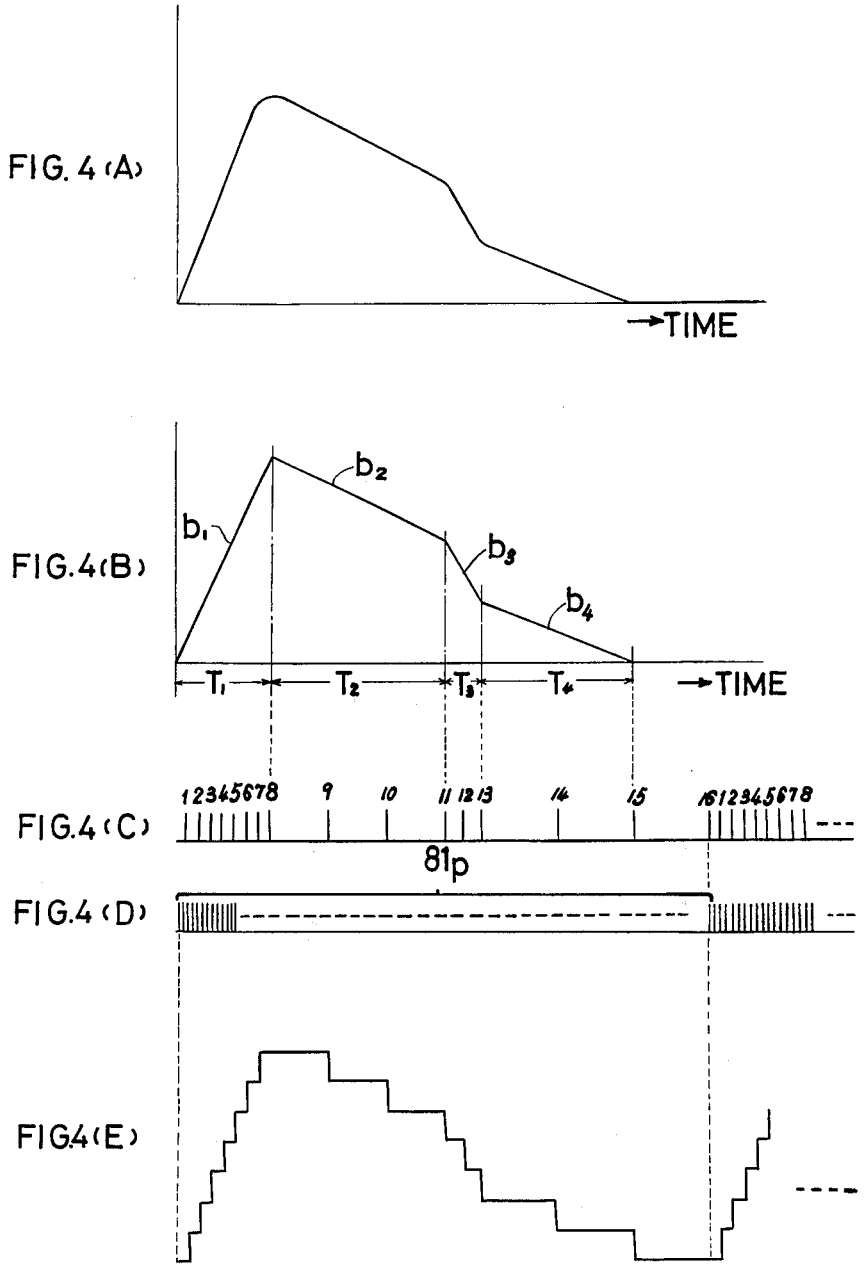
FIG. 4(A) is a diagram showing a musical tone waveform intended to be generated.
FIG. 4(B) is a diagram showing the waveform of FIG. 4(A) by connected line segments.
FIG. 4(C) is a diagram showing a series of pulses distributed according to inclinations of the line segments.
FIG. 4(D) is a diagram showing a series of pulses generated by a clock pulse oscillator of FIG. 1.
FIG. 4(E) is a diagram showing a waveform obtained at the output terminal of waveform forming means in FIG. 1 as a result of the series of pulses in FIG. 4(D) being applied to a pulse-density varying means in FIG. 1.

A musical-tone waveform is shown, by way of example, in FIG. 4(A) as a waveform which it is desired be produced. A waveform closely resembling the same is depicted by section lines $b_1$, $b_2$, $b_3$ and $b_4$ as shown in FIG. 4(B). In proportion to the degrees of inclination of sections lines $b_1$, $b_2$, $b_3$ and $b_4$, sixteen pulses are distributed in varied density as shown in FIG. 4(C). The density of pulses for the section line $b_1$ is one-half that the output pulses of the clock-pulse oscillator 2, as illustrated in FIG. 4(*b*), so that the frequency-dividing ratio is 2. As shown in FIG. 2, two in a digital signal form is set in the first pulse-density setting portion 7*a*-1. The number of all the pulses within the section range T1 for the section line $b_1$ is 8, so that 8 is set in digital signal form, in the first section range setting portion 7*b*-1. Similarly, 10, 3 and 13 are set in the second to fourth pulse-density setting portions 7*a*-2, 7*a*-3 and 7*a*-4. In the meanwhile, 3, 2 and 3 are set in the second to fourth section range setting portions 7*b*-2, 7*b*-3 and 7*b*-4. $T_4$ is 2 as is clear from FIG. 4(B) and FIG. 4(C). Accordingly, the fourth section range setting portion 7*b*-4 should be set to be 2, but is set to be 3 to depict the zero portion of the waveform as shown in FIG. 4(E).

If a key is depressed, a signal generated at the keyboard circuit 1 resets the first, second and third counters 6, 8, and 10 and the decoder 9 and at the same time causes the clock-pulse generator 2 to oscillate. An output signal is obtained at the first output terminal of the decoder 9, whereby the first pulse-density setting portion 7*a*-1 and the first section range setting portion 7*b*-1 are selected. The first counter 6, which counts output pulses of the clock-pulse generator 2, is reset and generates a single pulse repeatedly each time two pulses are counted. In the meanwhile, the second counter 8, which counts output pulses of the first counter 6, each time eight pulses are counted is repeatedly reset and generates a single pulse which is applied to the decoder 9. The signal at the first output terminal of the decoder disappears and a signal can then be obtained at the second output terminal. Thus, the second pulse-density setting portion 7*a*-2 and the second section range setting portion 7*b*-2 are selected. Under this condition, the first counter 6 generates a single pulse for each of ten pulses. When the second counter 8 counts three pulses, the third pulse-density setting portion 7*a*-3 and the third section range setting portion 7*b*-3 are selected similarly as above. it is then twice repeated that a single pulse is generated for each counting of three pulses. Similarly, the fourth pulse-density setting portion 7*a*-4 and the fourth section range setting portion 7*b*-4 are selected, and it is three times repeated that a single pulse is generated for each counting of thirteen pulses, Then, the first pulse-density setting portion 7*a*-1 and the first section range setting portion 7*b*-1 are selected. This is repeated during the time the associated key is kept depressed.

As is clear from FIGS. 3(*c*) and (*d*), the output digital signals of the exclusive-OR-gate circuit group 12 repeat 0,1 . . . 7,7 . . . 1,0. Accordingly, the output analog signals of the D-A converter 13 repeat, increasing and increasing in a stepped wave form of 0,1 . . . 7,7,6 . . . 0. Thus, according to the foregoing pulse-density change, a stepped form of waveform as shown in FIG. 3(E) can be represented.

As is clear from the above explanation, one cycle of a stepped form of musical-tone waveform is represented by 81 pulses generated by the clock pulse oscillator 2. Accordingly, the oscillator frequency of the clock pulse oscillator 2 should be 81 times the frequency of the musical tone to be obtained. This stepped form of musical-tone waveform thus obtained is diminished by being passed through a filter and thus becomes more similar to the waveform of FIG. 4(A).

To clarify the above, let it be assumed that the first pulse-density setting portion (7*a*-1) is set at "2" and the first section setting portion (7*b*-1) is set at "8" as illustrated. Accordingly, it is repeated that 2 clock pulses are counted eight times, and thus the number of clock pulses counted is $2 \times 8 = 16$.

The second pulse-density setting portion (7*a*-2) is set at "3" and the second section setting portion (7*b*-2) is set at "10". Accordingly, it is repeated that 3 clock pulses are counted 10 times, and thus the number of the counted clock pulses is $3 \times 10 = 30$. The third pulse-density setting portion (7*a*-3) is set at "2," and the third section setting portion (7*b*-3) is set at "3." Accordingly, the number of counted clock pulses becomes $2 \times 3 = 6$. The fourth pulse-density setting portion (7*a*-4) is set at "3," and the fourth section setting portion (7*b*-4) is set at "13." Thus, the number of the counted clock pulses becomes $3 \times 13 = 39$. The total sum of the numbers of counted pulses is $16 + 30 + 6 + 39 = 81$. A single musical tone waveform is thus drawn by 81 pulses.

If a series of input pulses applied to the waveform forming means 4 is varied in density, a stepped form of waveform signal can be obtained at an output terminal thereof. It is clear that various kinds of waveforms can be obtained by properly setting the pulse-density setting portions 7*a*-1 . . . 7*a*-4 and the section range setting portions 7*b*-1 . . . 7*b*-4 of the memory circuit 7.

Additionally, it is clear that a waveform having a fine change can be obtained if the number of flip-flop circuits and the number of exclusive-OR-gate circuits are increased or, additionaly, the number of pulse-density setting portions and that of the section range setting portions are increased.

In the above illustrated embodiment, the second counter 8 is designed to count output pulses of the first counter 6. The circuit can be modified so that it counts input pulses applied to the first counter 6, that is, output pulses of the clockpulse generator 2. In this case, however, it is required that the first to fourth section range setting portions 7*b*-1 . . . 7*b*-4 are set by the number of all the output pulses of the clock-pulse generator 2 in each section range.

Figure 7:
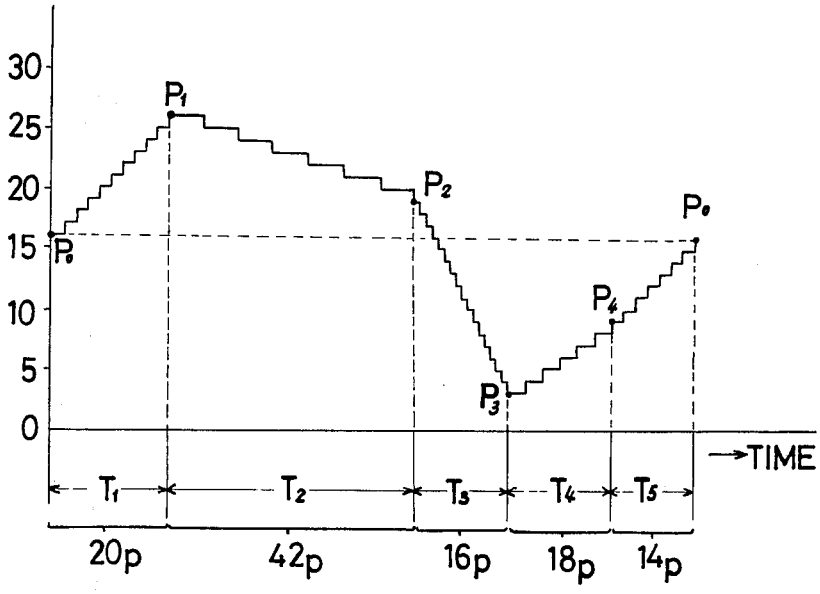

As is clear from the above explanation, a waveform which can be obtained by this arrangement is such that it increases as 0, 1, 2 . . . 7 and then decreases as 7, 6 . . . 0, but a waveform which increases or decreases in the middle thereof can not be obtained. In the embodiment as shown in FIGS. 5 and 7, increases and decreases in the middle of the waveform can be produced freely.

Figure 5:
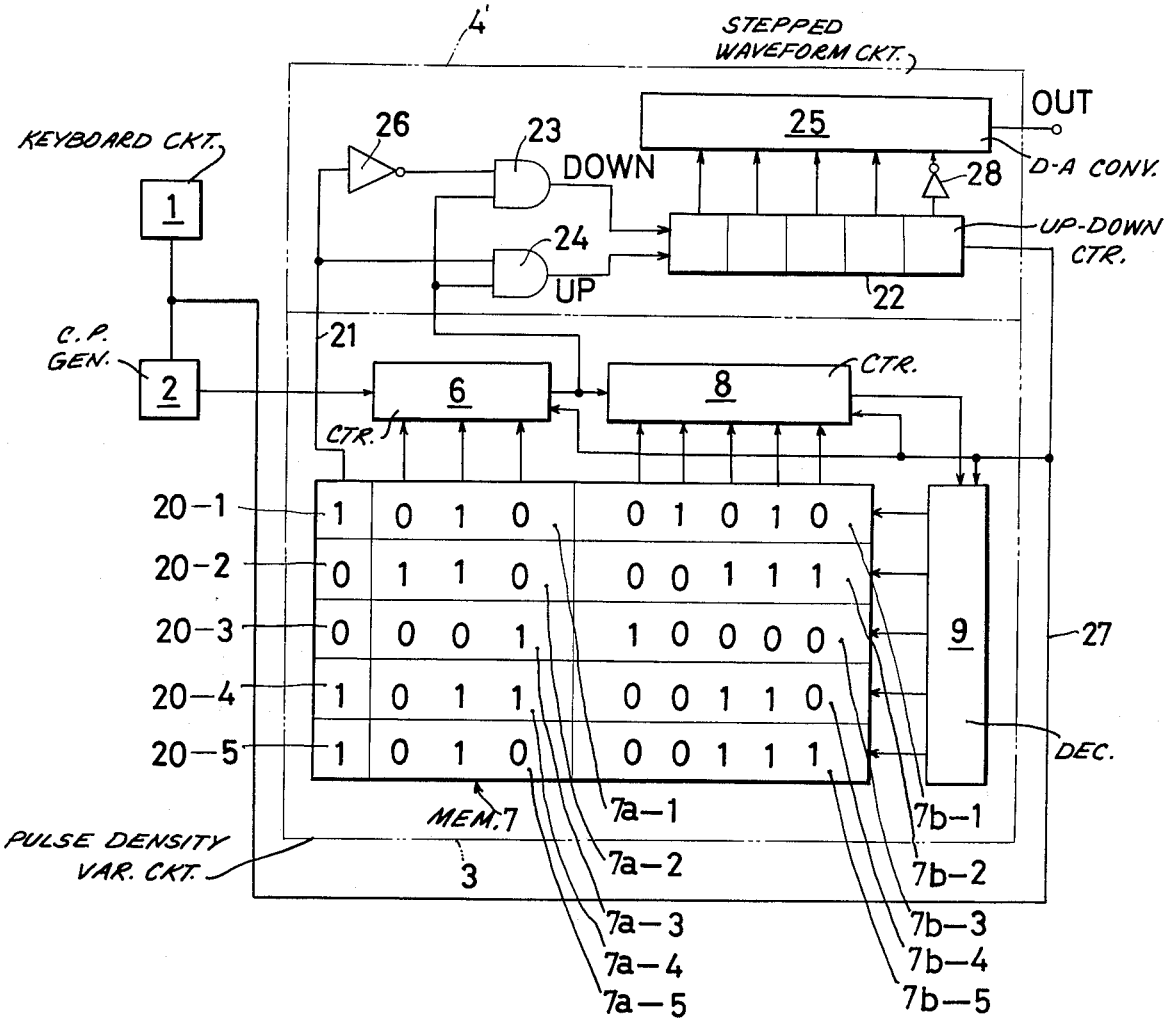
FIG. 5 is a block diagram showing another embodiment of this invention.

In FIG. 5, circuits 20-1, 20-2 . . . 20-5 are increase and decrease tendency setting portions for setting increase and decrease tendency of sections lines. Those portions are provided on the side of the first to fifth pulse-density setting portion *7a*-1, *7a*-2 . . . *7a*-5 of the memory circuit 7. It is so arranged that each of those may be selected by output signals of the decoder 9, according to selection of the pulse-density setting portions *7a*-1 . . . *7a*-5 and the section range setting portions *7b*-1 . . . *7b*-5. the setting portions 20-1 . . . 20-5 are each so constructed that increase and decrease are set by "1" or "0." The output terminals thereof are composed of a single common lead 21 which is connected to a stepped-waveform forming circuit 4' (which will be described hereinafter) along with an output terminal of the first counter 6.

The stepped waveform forming circuit 4' comprises an up-down counter 22, AND gates 23,24 connected to the DOWN terminal and the UP terminal, respectively at the input side of counter 22, and a D-A converter 25 provided on the output side of the up-down counter 22 and a NOT circuit 26 connected to one of the input terminals of one of the AND gates, that is, of the AND gate 23. The input of the NOT circuit 26 and one input terminal of the AND gate 24 are connected in common to the lead 21. The other input terminals of these two AND gates 23 and 24 are connected in common to an output terminal of the first counter 6.

A lead 27 is connected in common to reset terminals of the first and second counters 6 and 8, the decoder 9 and the up-down counter 22, and is connected to the keyboard circuit 1, so that counters 6, 8, 9 and 22 can be reset at the instant of key depression. Following the resetting, a new counting begins.

Figure 6:
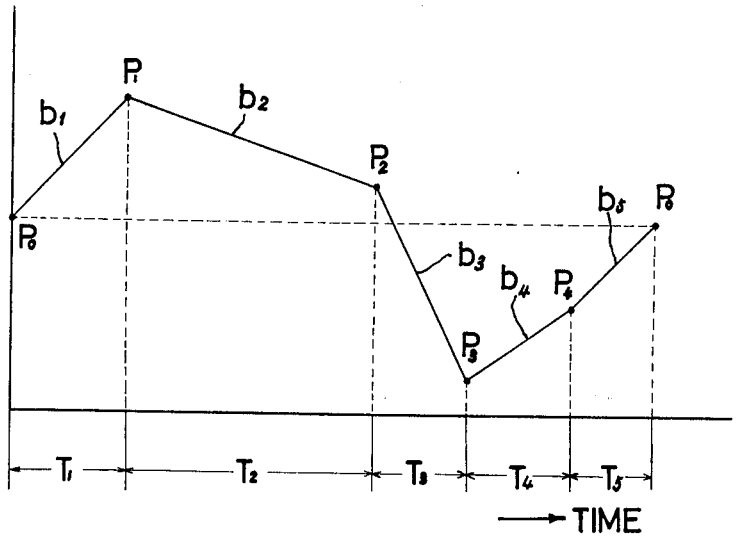
FIGS. 6 and 7 are respectively diagrams for an explanation of the operation of the same.

FIG. 6 shows a musical waveform formed by section lines approximating another musical-tone wave (not shown) which it is desired be obtained. Pulses are varied in density according to inclination angles of respective section lines $b_1 \ldots b_5$ as shown in FIG. 7. In the memory circuit 7 of FIG. 5, the increase-and-decrease-tendency setting portions 20-1 . . . 20-5, the pulse-density setting portions *7a*-1 . . . *7a*-6 and the section range setting portions *7a*-1 . . . *7a*-5 are respectively set.

If, under this condition, a key is depressed, the keyboard circuit 1 operates and a signal of the first output terminal of the decoder 9 selects the first increase-and-decrease-tendency setting portion 20-1, the first pulse-density setting portion *7a*-1 and the first section range setting portion *7b*-1, whereby there are obtained respective outputs "1," "010" and "01010." The first counter 6 repeats 10 times the generation of a single pulse and is reset each time it counts two pulses. An output of the first increase-and-decrease-tendency setting portion 20-1 is "1" as mentioned above and the same is applied to the AND gate 24, so that the output pulses of the first counter 6 can pass through the AND gate 24 to be applied to the UP terminal. Thereby, the output pulses of the first counter 6 can be counted.

In such a case, the up-down counter 22 counts, in order and as digital signals "00001," "00010," "00011" . . . to generate outputs, but it is arranged that counting begins with "16." In general, a subtraction calculation, which is inevitable sooner or later, is effected, and, if it should bring the resultant value below zero, negative outputs, that is, −"00001," −"00010," −"00011" must be made. However, such a calculation is impossible. Therefore, it is required to start with such a large number that it can never be made minus by a subsequent subtraction calculation.

Circuit 28 is a NOT circuit provided for this purpose, and it serves to convert "10000," that is, sixteen, to an output zero, namely "00000" of the up-down counter 22, so that counting can begin with "10000." Thus, the output pulses of the first counter 6 are counted from sixteen as shown in FIG. 7(A). When ten pulses are counted within the section range $T_1$, by the output pulse of the second counter 8, the signal of the first output terminal of the decoder 9 disappears and a signal is obtained at the second output terminal of the same. Thereby, the second increase-and-decrease-tendency setting portion 20-2, the second pulse-density setting portion *7a*-2 and the second section range setting portion *7b*-2 are selected. Since an output of the second increase-and-decrease-tendency-setting portion 20-2 is "0," the AND gate 23 has applied thereto a "1" through the NOT circuit 26. Accordingly, output pulses of the first counter 6 are applied therethrough to the DOWN terminal of the counter 22 for effecting a subtraction counting. The first counter 6 repeats such that the same generates a single pulse and is reset each time it counts six pulses of the clock-pulse oscillator 2. Thus, when the second counter 8 counts seven pulses, a pulse is generated and, due to this pulse, the signal of the second output terminal of the decoder 9 disappears and a signal is obtained at the third output terminal, whereby the third increase-and-decrease-tendency setting portion 20-3, the third pulse-density setting portion *7a*-3 and the third section range setting portion *7b*-3 are selected. In almost the same manner as above, counting is carried out until the fifth increase-and-decrease-tendency setting portion 20-5, the fifth pulse-density setting portion *7a*-5 and the fifth section range setting portion *7b*-5 are employed.

Thus, there can be obtained at the output terminal of the D-A converter 25 a stepped form of waveform as shown in FIG. 7 according to the change of pulse density at the first counter 6. If, thus, the fifth calculation is completed, a signal is again obtained from the first output terminals of the decoder 9 so that the above calculation is repeated.

In this example, one cycle of the stepped form of musical-tone waveform can be obtained by 110 pulses of the clock-pulse oscillator 2. Accordingly, the oscillation frequency of the oscillatory 2 must be 110 times the frequency of the musical tone to be produced.

As is clear from the above, since the up-down counter 22 counts input pulses to perform adding or subtracting calculations, if a noise pulse is applied thereto for certain reasons, this noise pulse is counted as a pulse for adding or subtracting and there may result an error in frequency or an error in wave height.

Figure 8:
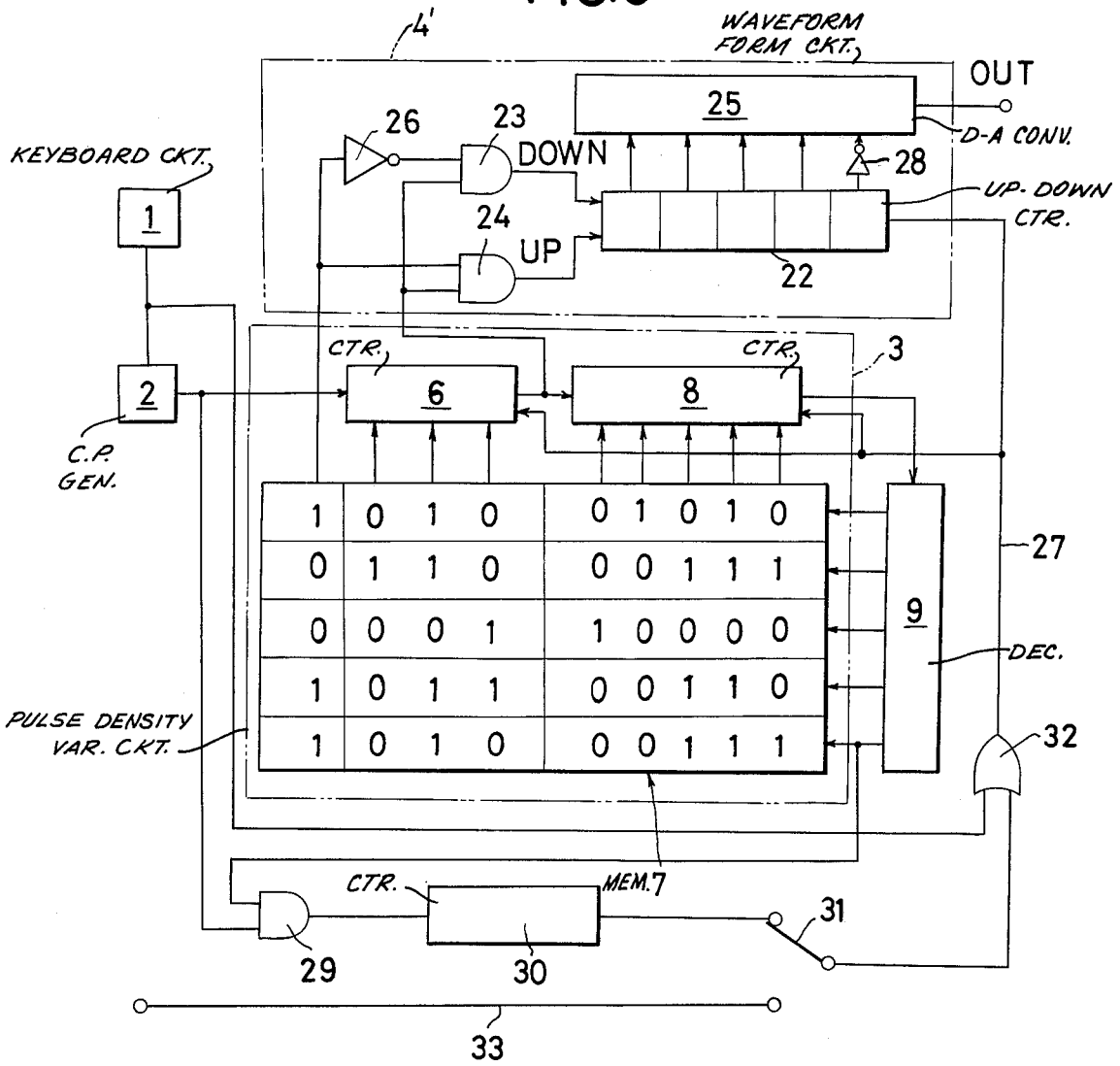
FIG. 8 is a diagram showing a further embodiment of the invention.

FIG. 8 shows an arrangement for removing this inconvenience. In FIG. 8, an AND circuit 29 is provided. An input on one side of the same is connected to the fifth output terminal of the decoder 9 while an input terminal on the other side of the same is connected to an output terminal of the clock pulse oscillator 2. An output terminal of the circuit 29 is connected to a lead 27 for resetting through a fourth counter 30 having a frequency-dividing ratio of 14, a changeover circuit 31 and an OR circuit 32. Another input terminal of the OR circuit 32 is connected to the output terminal of the keyboard circuit 1. If, thus, signals are generated, in order, from the first to fifth output terminal of the decoder 9, the AND circuit 29 is opened and output pulses of the clock-pulse oscillator 2 pass therethrough and 14 pulses are counted at the fourth counter 30.

On completion of this counting, a single pulse is sent out therefrom. Thereby, the first and second counter 6 and 8, the up-down counter 22 and the decoder 9 are reset. Thus, a new counting begins immediately thereafter and is carried out to form a stepped waveform as mentioned before. Thus, even where any error is caused at the time of forming of any stepped waveform, it can be amended immediately to a correct waveform. Additionally, there is provided a lead 33 connected to another terminal of the changeover switch 31. It is used, for instance, for being connected to an output terminal of a correct oscillator in another electronic musical instrument, whereby it can be utilized for producing a correct stepped waveform by the applying of a reset pulse as an output pulse thereof.

Figure 9:
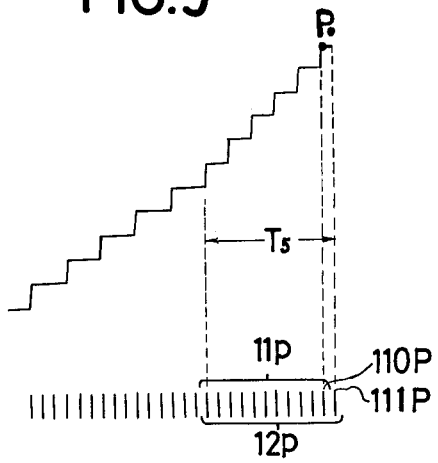
FIG. 9 is a diagram showing one manner of use of the circuit of FIG. 8.

The illustrated embodiment shown in FIG. 8 is applicable also to the case described below. It is narural that the pulse-density setting portions 7a-1 . . . 7a-5 and the section range setting portions 7b-1 . . . 7b-5 are set according to the inclination angles of the respective section lines $b_1 \ldots b_5$ so that the closest waveform may be obtained. A correct frequency of a musical-tone waveform desired to be produced is assumed to be 110 output pulses of the clock-pulse oscillator 2. In the meanwhile, the output pulses of the clock-pulse oscillator 2 are made by the above setting of 110 pulses as shown in FIG. 9, but appears as an incorrect musical-tone frequency which is longer in cycle by one pulse. If the fifth pulse-density setting portion is "010" and the fifth section range setting portion is "00110" for the final section line $b_5$, the frequency-dividing ratio of the frequency-divider 30 is set at 11. Thus, when one hundred and ten pulses are counted, a reset signal is generated and the first and second counters 6 and 6, the decoder 9 and the up-down counter 22 are reset, whereby a new counting begins with the one hundred and eleventh pulse. Accordingly, a correct musical-tone frequency can be obtained.

Thus, according to this invention, any desired musical tone waveform can be obtained by changing the density of pulses. The apparatus is simple in construction and can be easily formed as an IC type device.

What is claimed is:

1. A tone-source apparatus for an electronic musical instrument wherein at least one cycle of a musical tone waveform which is to be produced is depicted by a plurality of sections lines, each charaterized by degrees of inclination and length, said apparatus comprising means to generate a series of pulses having regular intervals, pulse-density varying means for varying the pulse-density of the pulses in accordance with the degrees of inclination of respective of the section lines whereby a resultant series of pulses having a varied pulse density is formed, said pulse-density varying means including a memory circuit including a plurality of pulse-density setting portions for selecting pulse densities and a plurality of section range setting portions for selecting output time intervals, and waveform forming means for forming the resultant series into said musical tone waveform.

2. An apparatus as claimed in claim 1, wherein said pulse-density varying means further comprises a first counter to which is applied, as an input, the series of pulses having regular intervals, a second counter connected to said first counter, said counter including input and output terminals, and a decoder connected to an output terminal of said second counter, said decoder including input and output terminals, said memory circuit being connected to the output terminals of the decoder, said plurality of pulse-density setting portions being coupled to and setting frequency-dividing ratios of the first counter for selecting output pulse densities for the same and said plurality of section range setting portions being coupled to and setting frequency-dividing ratios of the second counter for selecting output time intervals for signals obtained at respective of the output terminals of the decoder.

3. An apparatus as claimed in claim 2, wherein the first and the second counters are each constituted by a programmable counter.

4. An apparatus as claimed in claim 2, wherein said waveform forming means comprises a third counter connected to an output terminal of the first counter, said third counter including a plurality of flip-flop circuits which include input and output terminals, a group of exclusive-OR circuits connected to the output terminals of said flip-flop circuits and including output terminals, and a D-A converter connected to the output terminals of said exclusive-OR circuits.

5. An apparatus as claimed in claim 2, wherein the said memory circuit includes a plurality of increase-and-decrease tendency setting portions which are connected to the output terminals of the decoder for effecting increasing and decreasing of respective of said section lines, and said waveform forming means includes an up-down counter including a down terminal and an up terminal to which is selectively applied an input signal according to the generation of an increase signal or a decrease signal by said increase-and-decrease-tendency setting portions, and a D-A converter connected to output terminals of said up-down counter.

6. An apparatus as claimed in claim 5 comprising an AND gate circuit connected to the final stage of the decoder and to said means for generating a series of pulses having regular intervals, a further counter of which the frequency-dividing number is the number of output pulses of the latter said means corresponding to the final stage section line of one cycle, said further counter being coupled to said AND gate circuit, said further counter being connected to reset terminals of the first and second counters, the decoder and the up-down counter.

7. An apparatus as claimed in claim 1 comprising keyboard means to actuate the means for generating a series of pulses having regular intervals.

* * * * *